US009668931B2

(12) United States Patent
Nussbaum et al.

(10) Patent No.: US 9,668,931 B2
(45) Date of Patent: Jun. 6, 2017

(54) POST STROKE STIMULATION DEVICE AND TREATMENT METHOD

(76) Inventors: Eric S. Nussbaum, St. Louis Park, MN (US); Leslie A. Nussbaum, St. Louis Park, MN (US)

( * ) Notice: Subject to any disclaimer, the term of this patent is extended or adjusted under 35 U.S.C. 154(b) by 804 days.

(21) Appl. No.: 13/546,197

(22) Filed: Jul. 11, 2012

(65) Prior Publication Data

US 2013/0018289 A1 Jan. 17, 2013

Related U.S. Application Data

(60) Provisional application No. 61/506,406, filed on Jul. 11, 2011.

(51) Int. Cl.
*A61H 9/00* (2006.01)
*A61H 23/02* (2006.01)
(Continued)

(52) U.S. Cl.
CPC ..... *A61H 9/0071* (2013.01); *A41D 19/0027* (2013.01); *A61H 9/0078* (2013.01); *A61H 23/02* (2013.01); *A61H 2015/0021* (2013.01); *A61H 2015/0042* (2013.01); *A61H 2201/5035* (2013.01); *A61H 2201/5038* (2013.01); *A61H 2205/06* (2013.01); *A61H 2205/065* (2013.01); *A61H 2205/10* (2013.01)

(58) Field of Classification Search
CPC ..... A61H 7/00; A61H 7/001; A61H 9/0007; A61H 9/005; A61H 9/0071; A61H 23/00; A61H 23/006; A61H 23/04; A61H 23/02; A61H 23/0245; A61H 23/0254; A61H 23/0263; A61H 39/00; A61H 39/007; A61H 39/02; A61H 39/04; A61H 2201/12; A61H 2201/1207; A61H 2201/1215; A61H 2201/1238; A61H 2201/1635; A61H 2201/1645; A61H 2201/165; A61H 2205/065; A61H 2205/067; A61H 9/0078
See application file for complete search history.

(56) References Cited

U.S. PATENT DOCUMENTS 2,880,721 A * 4/1959 Corcoran ..... 601/151
3,908,642 A * 9/1975 Vinmont ..... 601/149
(Continued)

FOREIGN PATENT DOCUMENTS

WO WO2006081883 * 8/2006

OTHER PUBLICATIONS

Whisker Stimulation Enhances Angiogenesis in the Barrel Cortex Following Focal Ischemia in Mice; Vivian R. Whitaker et al.; Journal of Cerebral Blood Flow and Metabolism; (2007) 27, pp. 57-58.

(Continued)

*Primary Examiner* — Justine Yu
*Assistant Examiner* — Michael Tsai
(74) *Attorney, Agent, or Firm* — Patterson Thuente Pedersen, P.A.

(57) ABSTRACT

A post-stroke stimulation device including a garment to be applied to a portion of a body of a stroke patient to be treated. The post-stroke stimulation device includes at least one tactile actuator adapted to supply tactile stimulation to the skin of the stroke patient. The tactile actuators are controlled to be activated and deactivated in a random pattern or a pattern selected by a medical professional.

13 Claims, 12 Drawing Sheets

(51) Int. Cl.

| | |
|---|---|
| ***A41D 19/00*** | (2006.01) |
| *A61H 15/00* | (2006.01) |

(56) References Cited

U.S. PATENT DOCUMENTS

| | | | | |
|---|---|---|---|---|
| 4,280,487 | A * | 7/1981 | Jackson | 601/150 |
| 5,143,505 | A | 9/1992 | Burdea et al. | |
| 5,241,953 | A * | 9/1993 | Sykes | A61H 9/00 601/165 |
| 5,583,478 | A * | 12/1996 | Renzi | G06F 3/014 340/407.1 |
| 6,042,555 | A | 3/2000 | Kramer et al. | |
| 6,632,188 | B2 * | 10/2003 | Thomas et al. | 601/152 |
| 6,986,779 | B2 * | 1/2006 | Begley et al. | 606/204 |
| 7,551,161 | B2 * | 6/2009 | Mann | G10H 1/0008 345/156 |
| 2003/0074711 | A1 * | 4/2003 | Iversen | 2/69 |
| 2005/0080366 | A1 * | 4/2005 | Cushman | 601/148 |
| 2006/0190026 | A1 * | 8/2006 | Sanders | 606/204 |
| 2010/0106050 | A1 * | 4/2010 | Lau | A61H 39/007 600/557 |
| 2010/0249675 | A1 | 9/2010 | Fujimoto et al. | |
| 2011/0118560 | A1 | 5/2011 | Eckhoff et al. | |

OTHER PUBLICATIONS

Enhanced Neurogenesis and Cell Migration Following Focal Ischemia and Peripheral Stimulation in Mice; Wen-Lei Li et al.; Dev Neurobiol; Nov. 2008; pp. 1474-1486.

Electrical Forepaw Stimulation During Reversible Forebrain Ischemia Decreases Infarct Volume; American Stroke Associate; Mark G. Burnett et al.; Stroke 2006; 37:1327-1331.

International Search Report of PCT/US2012/046177, Jan. 28, 2013; Eric S. Nussbaum et al.; 5 pages.

Written Opinion of the International Search Report of PCT/US2012/046177; Jan. 28, 2013; Eric S. Nussbaum et al.; 6 pages.

International Preliminary Report on Patentability for International Application No. PCT/US2012/046177, dated Jan. 14, 2014, 7 pages.

* cited by examiner

POST STROKE STIMULATION DEVICE AND TREATMENT METHOD

CLAIM TO PRIORITY

This application claims the benefit of U.S. Provisional Application 61/506,406 filed Jul. 11, 2011 and entitled "Post-Stroke Stimulation Device And Treatment Method" the entire contents of which are incorporated herein by reference.

FIELD OF THE INVENTION

The present invention relates generally to the treatment of stroke and individuals recovering therefrom. More particularly, the present invention relates to garment like structures, used to provide therapy by application to peripheral parts of the body.

BACKGROUND OF THE INVENTION

It has been demonstrated in an animal model using rodents, that rodents subject to stroke that are also the subject of early sensory stimulation applied to an affected part of the body results in significantly improved neurologic outcomes from the ischemic injury. The explanation for this outcome is as yet unclear, but may be due to either early recruitment of collateral blood supply to the affected area of the brain or to neuronal reorganization. Increased blood flow to the area of the brain injured by stroke may result in less tissue injury and faster healing. Under the neuronal reorganization theory, the brain may re-route signals through collateral nerve routes surrounding or bypassing the damaged area and thus allow for heightened functional recovery. Other mechanisms may also apply.

SUMMARY OF THE INVENTION

Regardless of the mechanism by which improved outcomes occur, the present invention presents a simple and safe strategy to improve the outcome of recovery from acute ischemic brain injury (stroke) and also possibly to improve the recovery from other forms of brain injury including traumatic and iatrogenic insults.

The invention will be discussed herein in the context of a glove like device to be applied to an affected upper extremity of the stroke victim during the acute phase following a stroke. It is to be understood that in addition to treatment applied to the hand, the invention also encompasses garments to be applied to the foot, the leg, the arm or other body parts wherein the garments function in a similar fashion. Accordingly, features of the invention discussed in the context of a glove are to be considered examples and not to be limiting.

A post-stroke stimulation device in accordance with an example embodiment of the invention is supplied as a glove like garment or device to be applied to the affected upper extremity of the stroke victim during the acute phase of a stroke. In this example embodiment, the glove provides sensory stimulation to the hand. The sensory stimulation is largely tactile in nature. The tactile stimulation may be produced by a stroking movement, vibration, or by temperature change. Sensory stimulation of the hand stimulates a large amount of tissue in the sensory areas of the brain, thereby taking advantage of collateral recruitment, cortical reorganization or whatever recovery mechanism the brain employs in recovery from stroke. It is expected that application of the invention will improve human outcomes from acute stroke injury to the brain.

It is notable that the hand is greatly over-represented in the sensory and motor areas of the brain. In other words, despite the relatively small size of the hands in comparison to the rest of the body, there is a very large amount of brain tissue in the sensory and motor control regions of the brain devoted to receiving sensation from and controlling the movement of the hands.

The glove of the present example embodiment of the invention resembles a standard glove that fits over the affected hand of the individual to be treated. The glove may be a one size fits all item, although several sizes may be used if necessary to accommodate variations in hand size.

According to an example embodiment of the invention, a glove or other garment covering all or portion of a limb, includes a plurality of tactile actuators. In the example embodiment of the glove in accordance with the present invention, tactile actuators are distributed over the portion of the glove which fits over the palm surface of the hand and fingers. For example, each finger of the glove may include three tactile actuators spaced to correspond roughly with the arrangement of the individual phalanges of the patient's hand. Tactile actuators can also be arranged over the thumb and various portions of the palm. In a further embodiment of the invention, tactile actuators may also be positioned over the portion of the glove covering the back of the hand.

In an example embodiment, the tactile actuators may be pneumatically driven.

In another example embodiment of the invention, the tactile actuators may take the form of pneumatic pads that expand when inflated or pneumatic pads that produce a jet or flow of air to stimulate the surface of the skin.

In an example embodiment of pneumatic actuators, the glove of the present invention is made of a double layer of substantially air impermeable material. The glove is divided into a plurality of isolated sections by internal partitions. In this embodiment, the area enclosed by each internal partition serves as an actuator. Each individual actuator is coupled to an air pump or source of compressed air by appropriate air lines. The air lines are controlled by valves or other control members so that air flow to each pneumatic actuator is controlled individually.

In a variation of this example embodiment, the inner side of the glove which is in contact or near the person's skin has a number of small apertures in it. Thereby, air pumped into each of the tactile actuators escapes through the holes to provide a gentle blowing of air against the skin of the patient being treated, thereby providing sensory stimulation to the hand, both by the air blowing and by the pressure created by inflation of the pneumatic tactile actuators. In other embodiments of the invention, either the air movement or expansion and pressure of the tactile actuators may be used independently of the other.

In another embodiment of the invention, the tactile actuators may include electric motor driven massage rollers which are driven by the motor to gently stroke or massage the surface of the skin of the hand.

For example, each tactile actuator may include a small motor driving small massage rollers. In this embodiment of the invention, when each individual motor is actuated, the massage rollers rotate or otherwise travel to provide a gentle massaging of the skin. The rollers may be oriented to contact the skin substantially parallel to or substantially perpendicular to the axis of rotation of the motors. In accordance with the invention, at least some of the tactile actuators are controlled so as to be activatable individually. The tactile actuators may be controlled for example by a computer system and appropriate interfaces.

In another embodiment of the invention, the motorized tactile actuators apply a rolling massage like motion which would be a very gentle stimulation. The rollers are covered with a soft material contacting the skin. A rolling pad of a soft compressible material such as foam is expected to limit the risk of pressure injury to the underlying tissue stimulated. The motors may be electrical, pneumatic or hydraulic in nature.

In yet another embodiment of the invention, the tactile actuators may include piezoelectric actuators. The piezoelectric actuators may be controlled to vibrate or otherwise move upon application of electrical current to the piezoelectric actuators. The vibration or movement then creates a tactile sensory stimulus to the hand or other body part.

In another embodiment of the invention, tactile actuators may include electrically driven mechanical vibrators that provide tactical stimulation by vibrating upon application of an electric current.

In yet another embodiment of the invention, the tactile actuators may include actuators that apply hot or cold stimuli to the surface of the skin.

In still a further embodiment of the invention, the tactile actuators may include hydraulically actuated stimulus producers.

In yet another example embodiment of the invention, the glove or other garment includes motor actuators that directly manipulate or move, for example, the fingers of the hand while providing massaging type stimulation to the hand and fingers. In the known state of the art, there is presently no clear evidence that externally induced movement of the affected extremity has any greater beneficial effect than sensory stimulation of the hand or other extremities, but this type of manipulation may provide improved outcomes.

Again, it is of note that while the invention is discussed here in the context of a glove to be applied to the hand, the invention is applicable to any body part and may take the form of a boot applied to an affected foot or another form of garment such as a sleeve to be applied to the arms, legs or other body part.

It is also notable that the simple application of a static glove or other garment is not expected to be sufficient to provide ongoing sensory stimulation that may benefit the brain. With a stationary application, after a short period of time the sensory nerves habituate and there is no longer ongoing stimulation provided by a static device.

It is further notable that the stimulation of the invention is tactile in nature and is not direct electrical stimulation of the hand or other treated body part.

The invention also includes a method of treatment of a hand or other body part by application of a tactile stimulation glove, boot or other garment as described above as soon as possible after the ischemic injury. It is expected that the tactile stimulating garment would be worn by the patient for the first weeks after a stroke over periods of one to two hours with ten minutes breaks at periodic intervals. The device in accordance with the present invention can be applied by paramedics in the field or upon arrival of the stroke victim to the hospital or other treatment center.

In accordance with the invention, future clinical studies are expected to be performed to determine optimal duration of application of the device to maximize recovery benefit. It is expected that the earlier the device is applied to the stroke patient, the more potential benefit may be realized.

DETAILED DESCRIPTION

Figure 1:
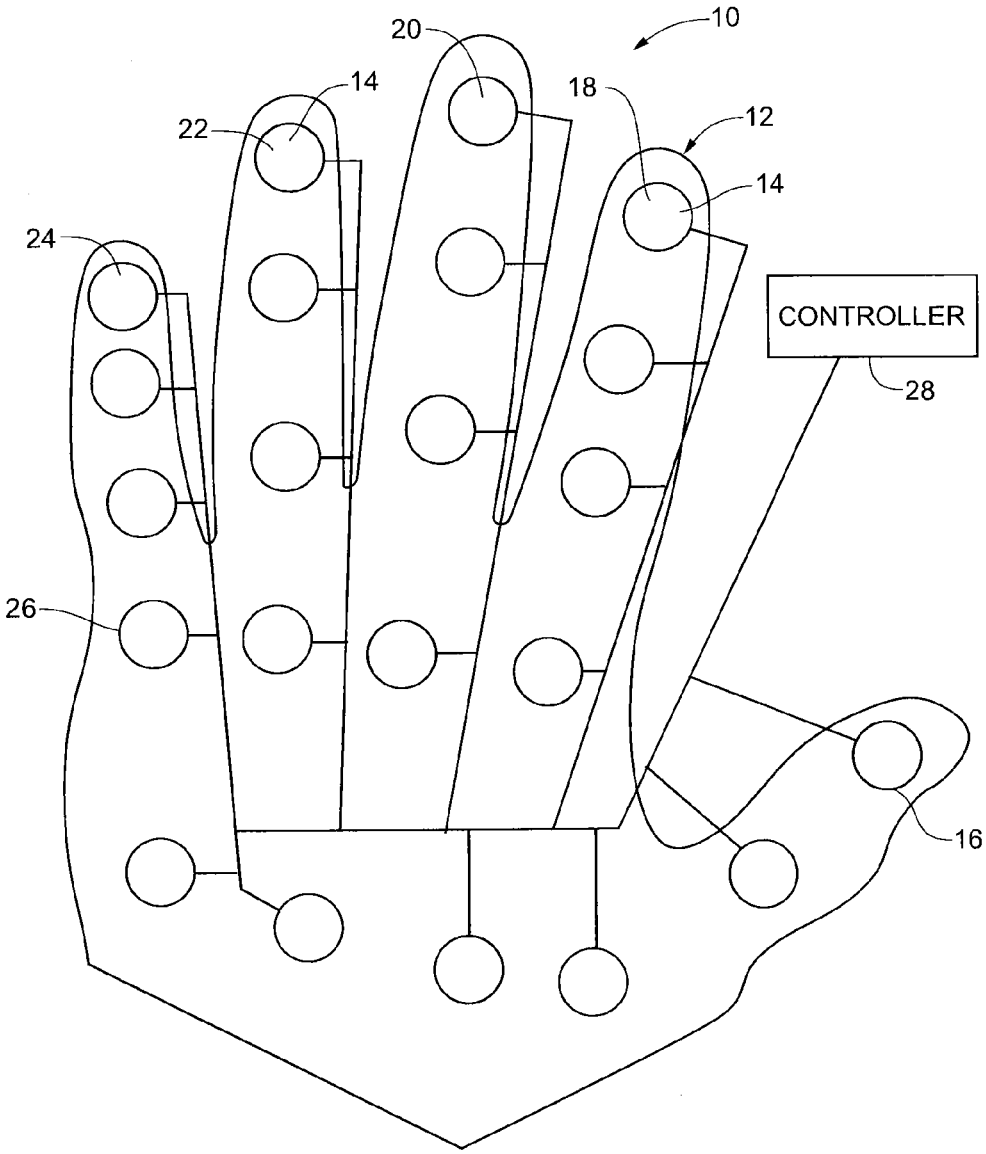
FIG. 1 is a schematic plan view of a glove like garment according to an embodiment of the invention.

Referring to FIG. 1, a schematic plan view of post-stroke stimulation device 10 is depicted. This embodiment post stroke stimulation device 10 is depicted as glove 12.

Glove 12 includes a plurality of tactile actuators 14. Tactile actuators may include thumb actuators 16, index finger actuators 18, second finger actuators 20, third finger actuators 22, fourth finger actuators 24 and palm actuators 26. Tactile actuators 14 are operably coupled to controller 28.

Figure 2:
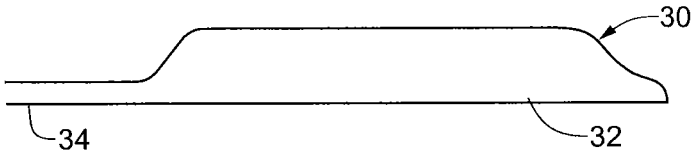
FIG. 2 is a cross section of a pneumatic actuator according to an embodiment of the invention.
Figure 3:
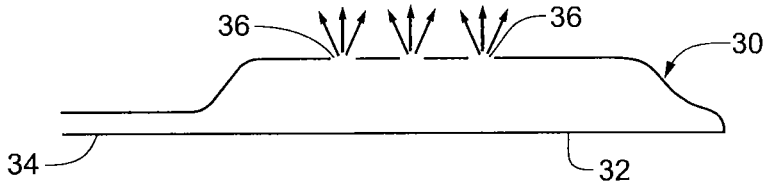
FIG. 3 is a cross section of another pneumatic actuator according to an embodiment of the invention.

Tactile actuators 14 may include pneumatic actuators 30 as depicted in FIGS. 2 and 3. Tactile actuators 14 may also include electric motorized actuators, electric vibratory actuators or piezoelectric actuators. Tactile actuators 14 may also include temperature altering actuators, motor actuators which induce motion of the affected limb or extremity or hydraulic actuators.

Controller 28 varies in structure depending upon the type of tactile actuators 14 used. Controller 28 is configured to activate tactile actuators 14 so that at least some of tactile actuators 14 are individually activateable separately from others. Controller 28 is also configured so that an operator may select an activation pattern or a random pattern of activation of tactile actuators 14 so that a continuous variation and actuation of tactile actuators 14 provides stimulation to the affected extremity or body part of the patient under treatment.

Referring to FIG. 2, a cross section of an example pneumatic actuator 30 is depicted. Pneumatic actuator 30 includes actuator envelope 32 and air line 34 as depicted in FIG. 2. Actuator envelope 32 and air line 34 may be formed of a polymer material or another flexible material that is generally impermeable to air. Actuator envelope 32 is in fluid communication with air line 34. Air line 34 is in fluid communication with an air pump (not shown) or source of compresses air, controlled by controller 28.

Referring to FIG. 3, another pneumatic actuator 30 is depicted. In this embodiment, pneumatic actuator 30 includes actuator envelope 32 and air line 34 similar to the embodiment depicted in FIG. 2. In this embodiment, pneumatic actuators 30 further present stimulation apertures 36. Stimulation apertures 36 are formed in actuator envelope 32 directed toward the location at which the skin of patient being treated is located when post-stroke stimulation device 10 is applied to the treated individual's body. Stimulation apertures 36 may also include an area of air permeable material in actuator envelope 32.

Figure 4:
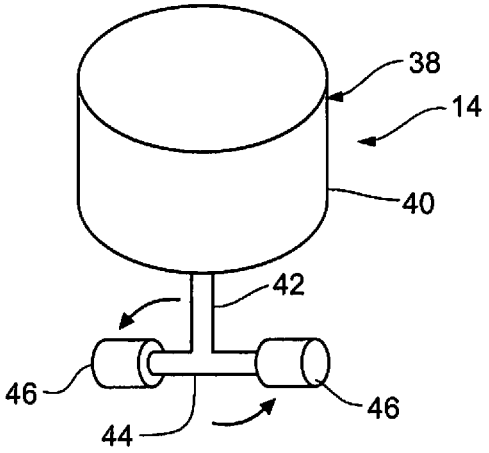
FIG. 4 is a schematic perspective view of a motorized tactile actuator according to an embodiment of the invention.

Referring to FIG. 4 another example of tactile actuators 14 is schematically depicted. Motorized actuators 38 generally include motor 40, motor shaft 42, cross-shaft 44 and cushioned rollers 46. Motor shaft 42 is driven by motor 40 so that cross-shaft 44 carrying cushioned rollers 46 revolves about motor shaft 42. Cushioned rollers 46 are cushioned with a soft pliable material appropriate to gently apply tactile stimulation to skin when motor shaft 42 revolves cushion rollers 46 against the skin.

Figure 5:
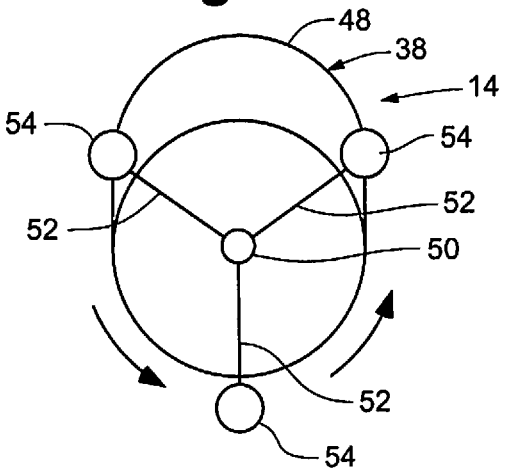
FIG. 5 is a schematic perspective view of a motorized tactile actuator according to another embodiment of the invention.
Figure 6:
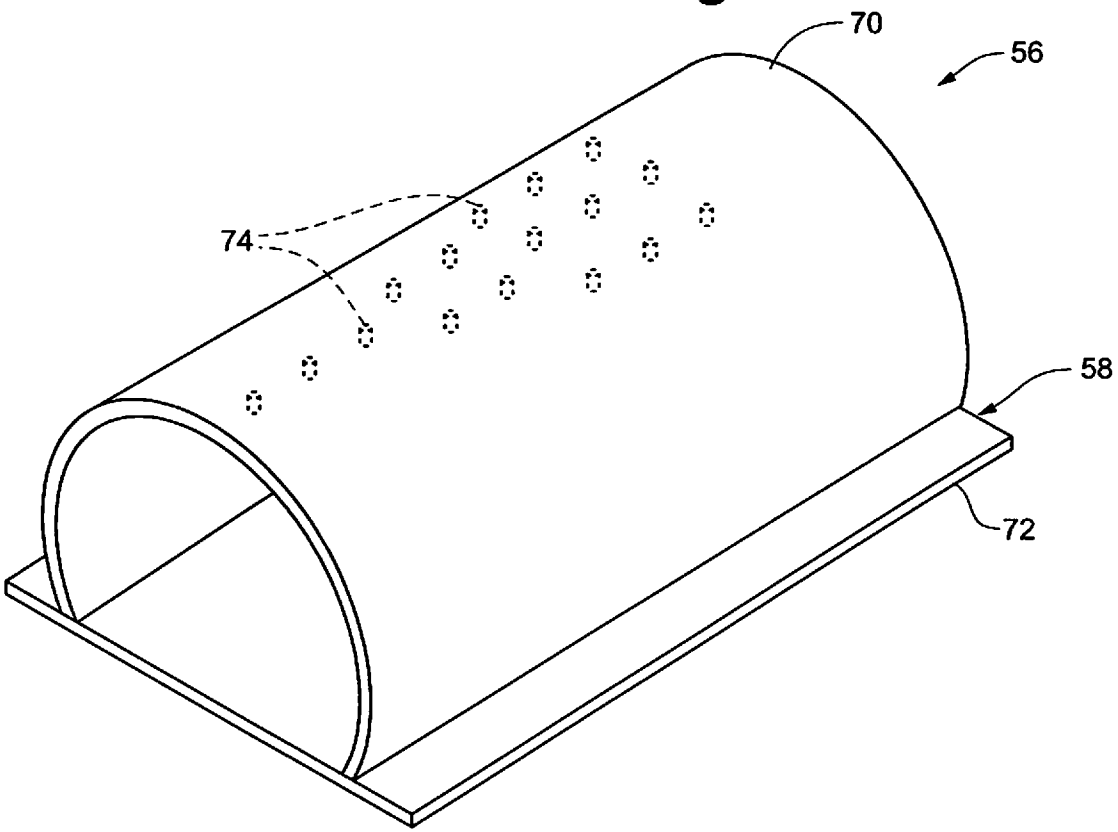
FIG. 6 is a perspective view of an air sleeve into which a body part may be inserted according to an example embodiment of the invention.
Figure 7:
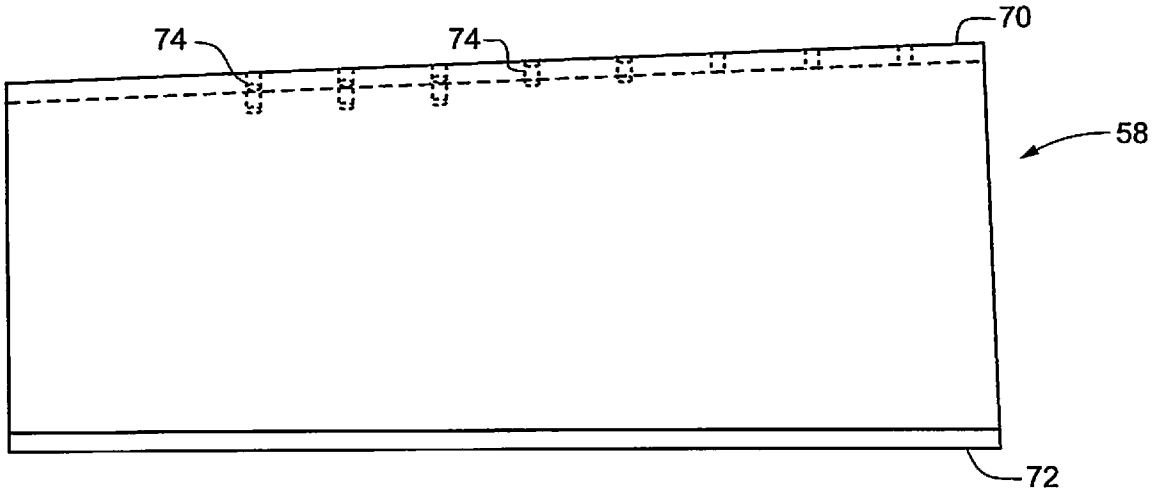
FIG. 7 is a sectional view of the air sleeve depicted in FIG. 6.
Figure 8:
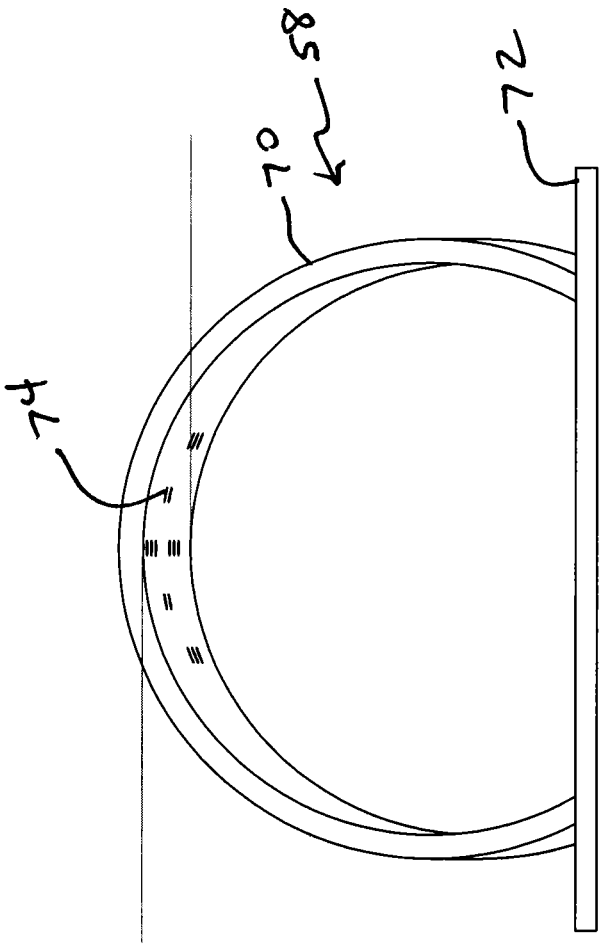
FIG. 8 is an elevational view of the air sleeve depicted in FIG. 6.

Referring to FIG. 5, another embodiment of motorized actuators 38 is depicted. In the depicted embodiment, motorized actuators 38 include motor 48, motor shaft 50, radial arms 52 and cushioned rollers spheroids 54. Motor 48 is operably coupled to motor shaft 50 which revolves radial arms 52. Each of radial arms 52 supports a cushion roller spheroid 54, adapted to contact and gently stroke the skin of a patient when cushion roller spheroids 54 are moved across the surface of the skin of the patient to provide tactile stimulation.

Figure 9:
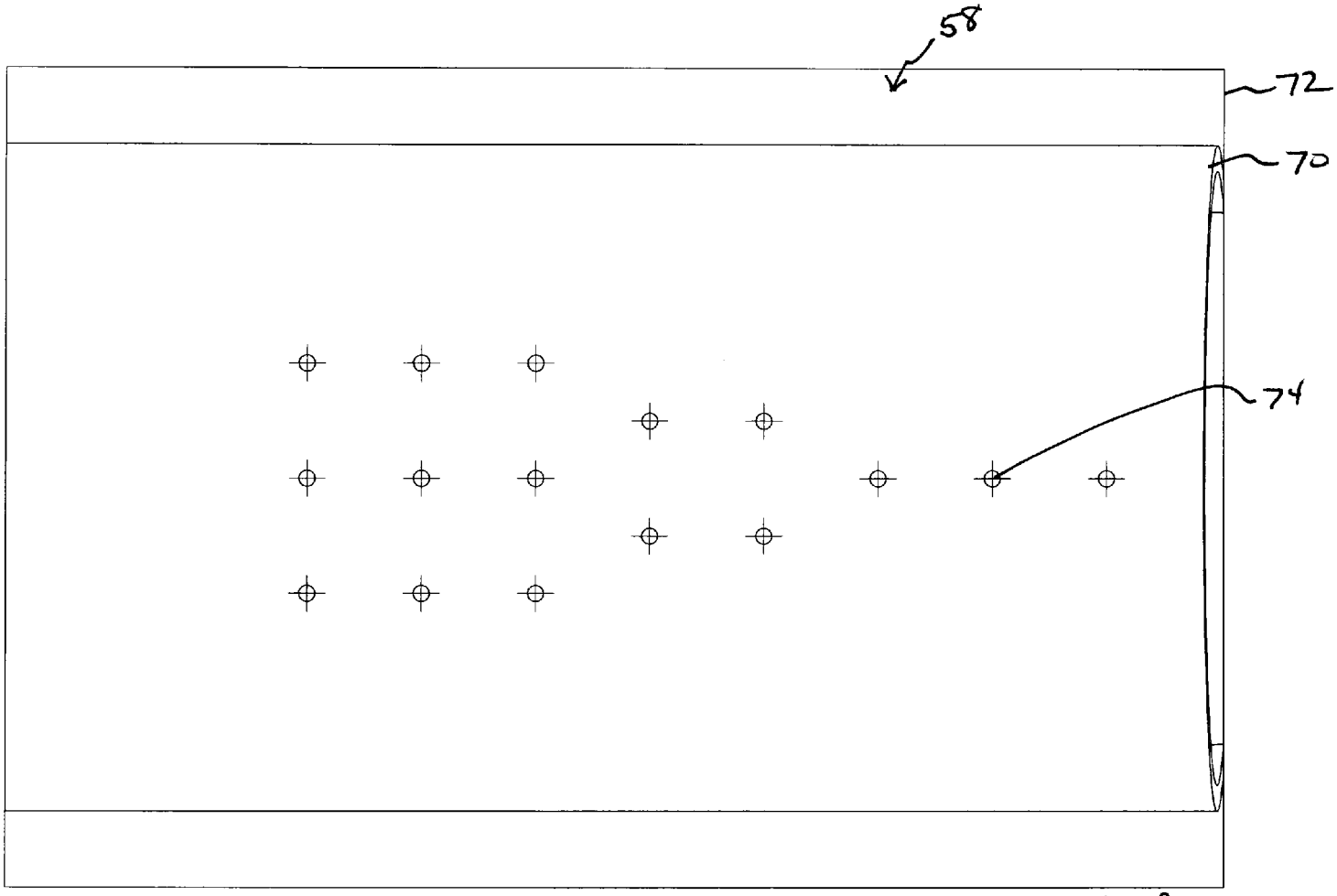
FIG. 9 is a top plan view of the air sleeve depicted in FIG. 6.
Figure 10:
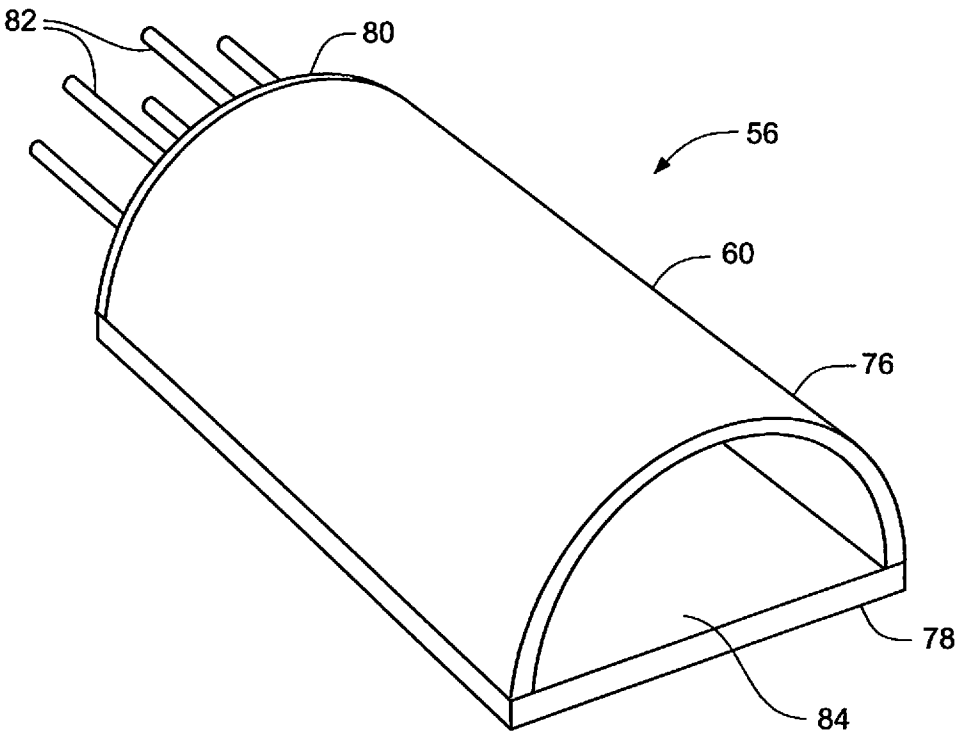
FIG. 10 is a perspective view of an end flow air sleeve according to an example embodiment of the invention.
Figure 11:
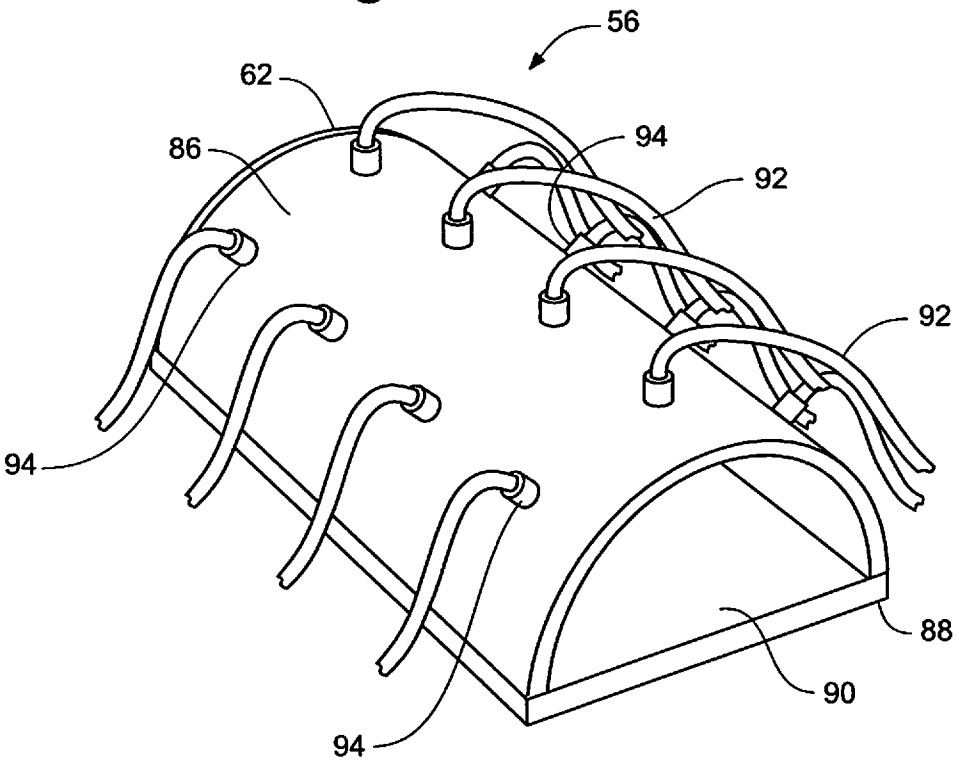
FIG. 11 is a perspective view, partially in phantom, of a perpendicular flow air sleeve according to an example embodiment of the invention.
Figure 12:
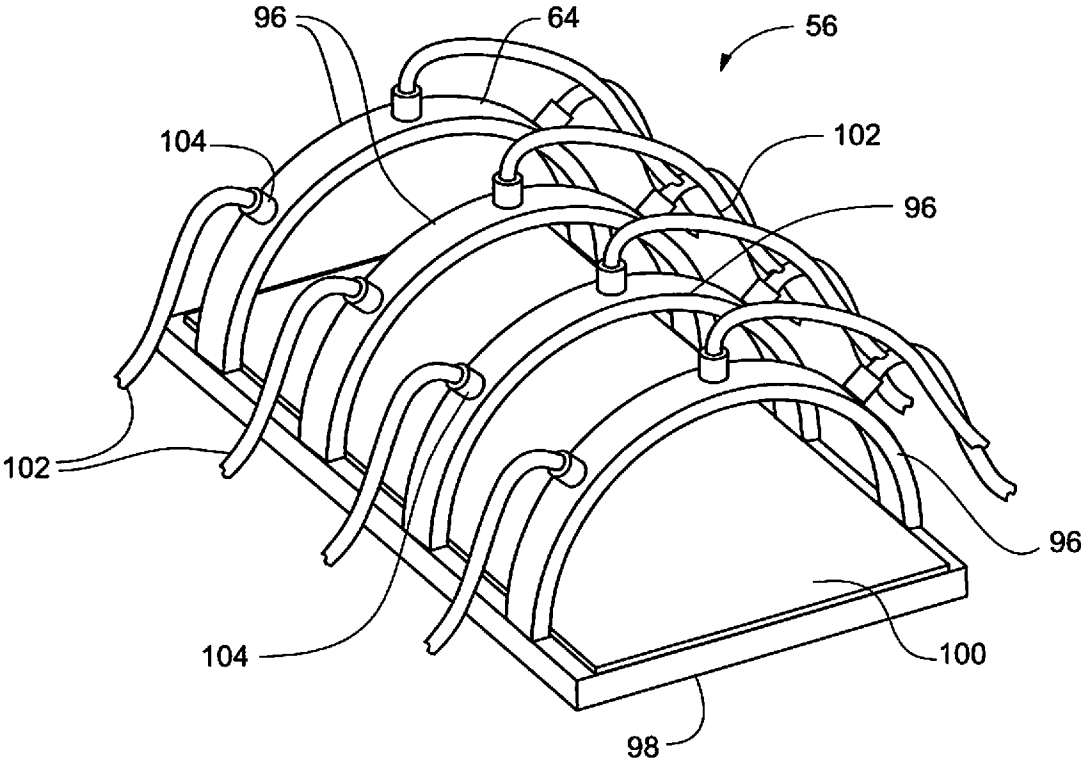
FIG. 12 is an open wire frame perpendicular flow air sleeve according to another example embodiment of the invention.
Figure 13:
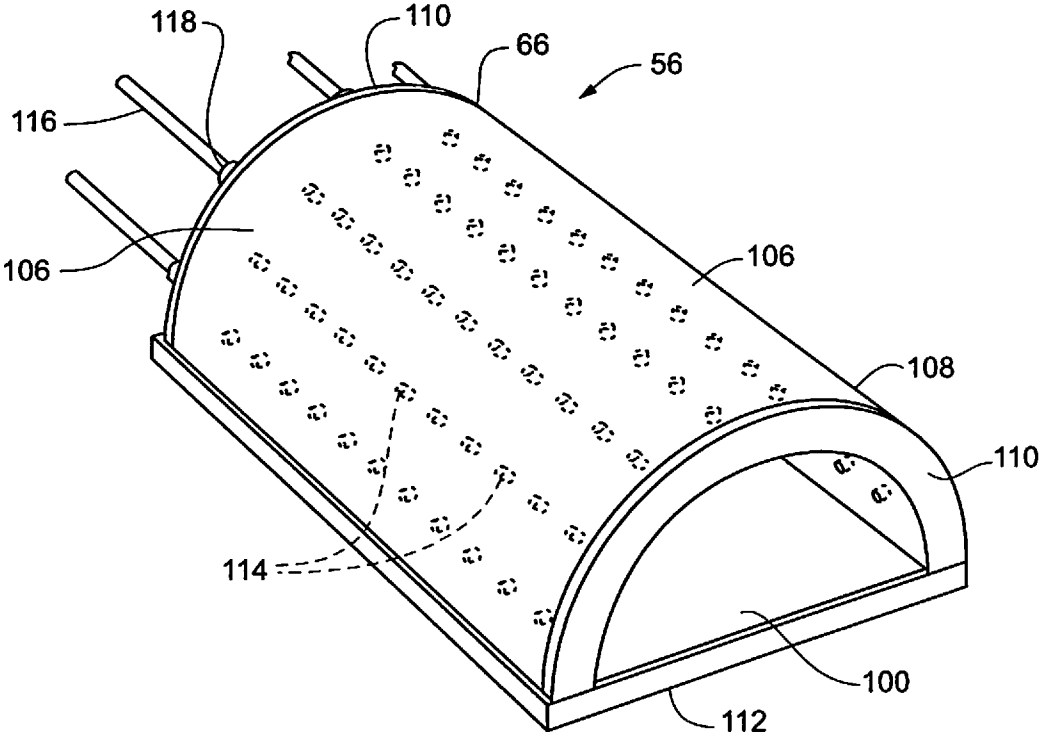
FIG. 13 is a perspective view, partially in phantom, of a dual-layer multiple-hole-flow air sleeve according to an example embodiment of the invention.
Figure 14:
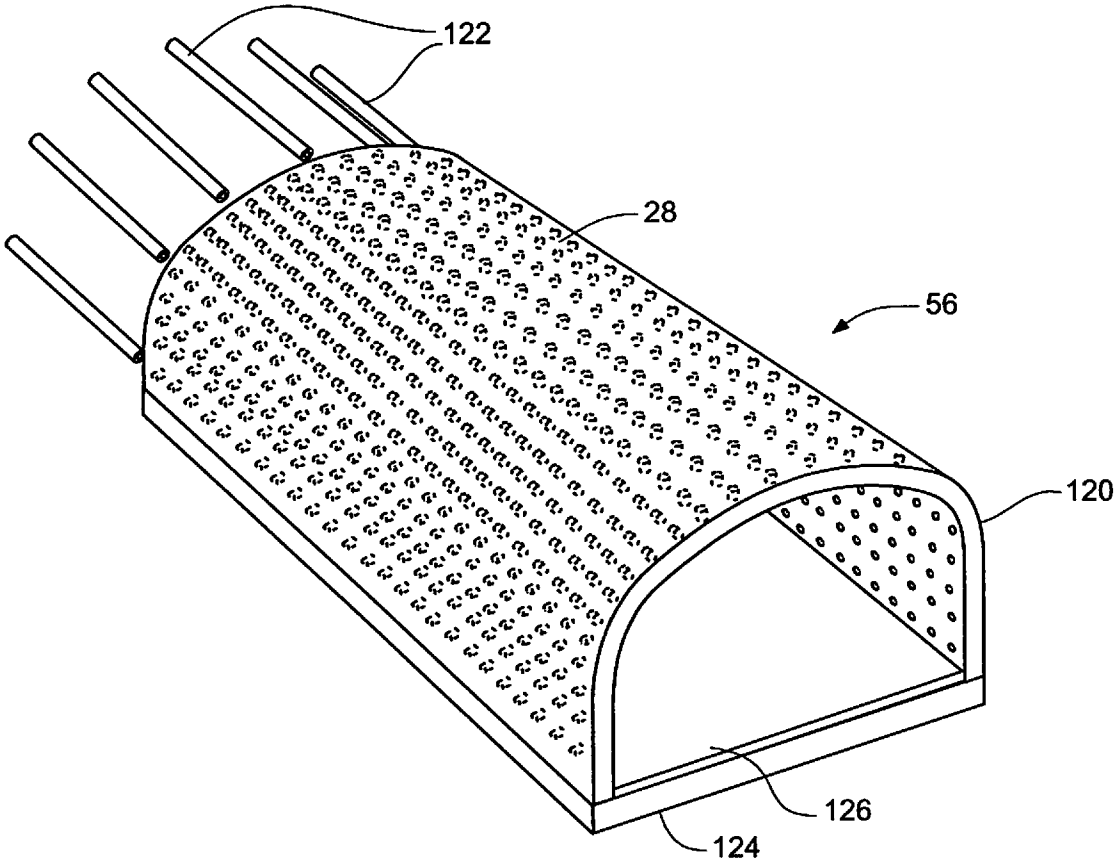
FIG. 14 is a perspective view of a multiple-hole-flow air sleeve according to an example embodiment of the invention.

Referring to FIGS. 6-14, according to another embodiment of the invention, post stroke stimulation device 10 may include one or more air sleeves 56. Air sleeves 56 may include single tube air sleeve 58 as depicted in FIGS. 6-9, end flow air sleeve 60 as depicted in FIG. 10, perpendicular flow air sleeve 62 as depicted in FIG. 11, wire frame perpendicular flow air sleeve 64 as depicted in FIG. 12, dual wall multiple hole flow air sleeve 66 as depicted in FIG. 13 and hollow cavity multiple hole flow air sleeve 68 as depicted in FIG. 14.

Referring FIGS. 6-9, single tube air sleeve 58 generally includes perforated tube 70 and base 72. Perforated tube 70 may be sized appropriately to receive therein a body part intended to be stimulated. For example, perforated tube 70 may be sized to receive a finger, a hand, an arm or a leg therein. Perforated tube 70 and base 72 may be formed of polymer materials that are unaffected by, for example, MRI imaging and transparent to x-rays used in other imaging techniques. For example, a may be advantageous to form these structures from PVC, polycarbonate or another polymer that is unaffected by magnetic fields and is transparent to x-ray radiation.

Referring again to FIGS. 6-9, perforated tube 70 is bonded to base 72. Perforated tube 70 is perforated by multiple air flow holes 74. According to the embodiment depicted in FIGS. 6-9, air flow holes 74 are oriented perpendicular to base 72. According to an example embodiment, air flow holes 74 may be, for example, 10-32 tapped through holes. Air flow holes 74 may be tapped to receive air tubule couplers (not depicted in FIGS. 6-9, but discussed further below).

FIG. 9 depicts one example pattern for placement of air flow holes 74. Other patterns may be used as well.

Referring to FIG. 10, end flow air sleeve 60 generally includes tube 76, base 78, end cap 80, air flow tubules 82 and padding 84. Tube 76 is bonded or otherwise secured to base 78. Base 78 may have padding 84 applied on top thereof facing inwardly toward tube 76.

In the depicted embodiment of the invention, air flow tubules 84 are secured to end cap 80 and pass air flow through end cap 80, generally parallel to a long axis of tube 76 and base 78. As discussed above, tube 76 and base 78 may be sized to receive any desired body part therein. For example, tube 76 and base 78 may be sized to receive individual fingers therein or larger body parts such as entire hand, arm or leg. Any number of air flow sleeves 60 may be used in the application of the invention.

Referring to FIG. 11, perpendicular flow air sleeve 62 generally includes tube 86, base 88, padding 90, air flow tubules 92 and tubule couplers 94. Tube 86 is bonded to base 88 in a similar fashion to the previously described structures. Padding 90 may be secured to base 88 therein. Air flow tubules 92 are coupled to tubule couplers 94, which may be threaded or otherwise adapted to be secured to air flow holes 74. In this example embodiment, tubule couplers 94 are secured to tube 86 so that air flow is perpendicular to a tangent line contacting the curved surface of tube 86.

Referring now to FIG. 12, wire frame perpendicular air flow sleeve 64 generally includes wire frame arches 96, base 98, padding 100, air flow tubules 102 and tubule couplers 104. Wire frame arches 96 are bonded to base 98. Padding 100 is secured to base 98 on an inside thereof. Air flow tubules 102 are coupled to tubule couplers 104, which are coupled in turn to wire frame arches 96 and direct air flow perpendicularly to wire frame arches 96 inwardly toward base 98.

Referring to FIG. 13, dual wall multiple hole flow air sleeve 66 generally includes inner tube 106, outer tube 108, end arches 110 and base 112. Inner tube 106 and outer tube 108 are bonded to end arches 110 enclosing a space within Inner tube 106, outer tube 108 and end arches 110 as assembled are bonded to base 112. Inner tube 106 presents inner wall perforations 114. This embodiment of the invention also includes air flow tubules 116 and tubule couplers 118. Tubule couplers 118 are secured to one end of arches 110 though they may be coupled at another location. Accordingly, air flow from air flow tubules 116 passes through tubule couplers 118 and into the space bounded by inner tube 106, outer tube 108 and end arches 110. Air flow then passes through inner wall perforations 114 inwardly.

Referring now to FIG. 14, hollow cavity multiple hole flow air sleeve 68 generally includes unitary arch with cavity 120, integral airflow tubules 122, base 124 and padding 126. In this embodiment, unitary arch with cavity 120 and integral airflow tubules 122 may be formed as a single unit and bonded to base 124. Padding 126 is applied to base 124.

General design considerations for air sleeve 56 according to an embodiment of the invention are as follows:

Air sleeve 56 is sized to fit at least the 95% male size of an appendage to be treated. It is desirable but not required for padding 84, 90, 100, 126 to be present on base 72, 78, 88, 98, 112, 124 of air sleeve 56. Air sleeve 56 is sized so that a body part to be stimulated can be easily inserted and removed from air sleeve 56. The air sleeve 56 is formed of MRI compatible material that is also transparent to x-rays.

According to the invention, air bursts may be applied for example, for approximately one to five seconds on followed by a period of one to five seconds off. Gentle flow of the air is desirable. Therefore, air should be applied at a low pressure and a low flow rate.

Air supply for post stroke stimulation device 10 of the present invention, may include various controller concepts. For example, air supply may be obtained from wall air in a hospital or a treatment facility and may be actuated manually by use of a pitch tube or a valve.

According to another embodiment of the invention, wall air may be utilized along with a microcontroller controlling a solenoid valve. According to an automated approach to the invention, pulse length, pulse frequency and pulse intensity are adjusted according to a selected program. According to another embodiment of the invention, the air supply may be provided by an integral air compressor with an electronic valve that is built into or coupled to post stroke stimulation device 10.

In operation, post stroke stimulation device 10 is placed on an extremity of a patient to be treated, such as on a hand. Controller 28 is set or programmed to provide regular changing stimulation via the post stroke stimulation device 10.

For example, controller 28 may be programmed so that actuation of tactile actuators 14 occurs in the following sequence. Thumb actuators 16 are activated and released, index finger actuators 18 are activated and released, second finger actuators 20 are activated and released, third finger actuators 22 are activated and released, fourth finger actuators 24 are activated and released and then palm actuators 26 are activated and released. The treatment cycle may then repeat from the beginning for example.

In addition, continuously variable programs may be desirable to reduce the likelihood of habituation to the treatment program. One of ordinary skill in the art will recognize that many various treatment programs are possible. Further, effective treatment protocols may be determined by future experimentation.

As discussed above, various tactile actuators 14 may be utilized. It is to be understood that controller 28 will vary in structure depending upon the type of actuators utilized. Controller 28 may include an air pump (not shown) for pneumatic actuators while electrically operated actuators may be controlled by electrical impulses. Tactile actuators 14 of other types have a controller 28 adapted accordingly.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed is:

1. A post-stroke stimulation device for treating a patient suffering from an ischemic or hemorrhagic injury of the brain, comprising:

a garment shaped and sized to receive an external patient body part therein, the garment received over and surrounding the external patient body part in a close, self-aligning fit with said external patient body part, and including an interior surface adapted for close, fitting apposition to the skin of the external patient body part when the garment is received by said external patient body part, the external patient body part having multiple areas of greater and lesser sensitivity; said garment interior surface including structure defining a plurality of stimulation apertures in said garment, said stimulation apertures positioned on said interior surface of said garment so as to be in predetermined positions relative to selected ones of said external patient body part multiple areas of sensitivity when said garment is received by said external patient body part in said close, self-aligning fit; and a pneumatic actuator in fluid communication with said stimulation apertures, said pneumatic actuator including a source of compressed air, and an air line assembly operably coupling said source of compressed air with said stimulation apertures; and a controller operably coupled with said pneumatic actuator and said air line assembly for selectively providing a flow of compressed air through selected ones of said stimulation apertures in a predetermined pattern, wherein the post-stroke stimulation device enables the rapid orientation and self-alignment of the garment on said external patient body part immediately following the onset of said ischemic or hemorrhagic injury of the brain for providing compressed air stimulation at said predetermined positions of said external body part, said predetermined portions of said external body part being related to areas of the brain related to the of the patient affected by the ischemic or hemorrhagic injury such that recovery from the ischemic or hemorrhagic injury is facilitated.

2. The post-stroke stimulation device as claimed in claim 1, wherein the garment comprises a glove and wherein multiple stimulation apertures are distributed over the glove so as to stimulate at least individual fingers of the hand.

3. The post-stroke stimulation device as claimed in claim 2, wherein the glove further comprises stimulation apertures position proximal to the patient's fingers and palm.

4. The post-stroke stimulation device as claimed in claim 1, wherein the garment comprises multiple stimulation apertures distributed over the garment so as to stimulate multiple portions of an external patient body part covered by the device.

5. The post-stroke stimulation device as claimed in claim 4, wherein the controller is operable to provide air to the multiple stimulation apertures in a predefined sequence.

6. The post-stroke stimulation device as claimed in claim 4, wherein the controller is operable to provide air to the multiple stimulation apertures in random sequence.

7. The post-stroke stimulation device as claimed in claim 2, wherein the garment further comprises an actuator envelope and an air line in fluid communication with the actuator envelope.

8. The post-stroke stimulation device as claimed in claim 7, wherein the actuator envelope presents the stimulation apertures directed toward the skin.

9. The post-stroke stimulation device as claimed in claim 7, wherein the stimulation apertures further present air permeable material in the actuator envelope.

10. A method of treating a patient suffering from stroke by application of a post-stroke stimulation device and controlling the post-stroke stimulation device; the method comprising:

identifying the patient suffering from signs of acute stroke, symptoms of acute stroke or both signs and symptoms of acute stroke;

applying the post-stroke stimulation device to an extremity of the patient affected by the stroke during an acute phase following the stroke as soon as possible after ischemic injury wherein the garment is shaped and sized to receive the extremity in a close, self-aligning fit with said extremity and includes an interior surface including structure defining a plurality of stimulation apertures, a pneumatic actuator and a controller, wherein said stimulation apertures are positioned relative to areas of sensitivity of said extremity, and said pneumatic actuator and controller are configured to selectively provide a flow of compressed air through selected ones of said stimulation apertures;

activating a first stimulation aperture of the post-stroke stimulation device that is disposed in contact with or near a skin surface at a first discrete location;

deactivating the first stimulation aperture;

activating a second stimulation aperture of the post-stroke stimulation device that is disposed in contact with or near the skin surface at a second discrete location; and deactivating the second stimulation aperture;

wherein portions of the brain related to the extremity of the patient affected by the stroke are stimulated because of tactile stimulation of the extremity and recovery from stroke is facilitated.

11. The method as claimed in claim 10, further comprising activating the first stimulation aperture and the second stimulation aperture in a predefined sequence.

12. The method as claimed in claim 10, further comprising activating the first stimulation aperture and the second stimulation aperture in a random sequence.

13. The method as claimed in claim 10, further comprising actuating additional stimulation apertures beyond the first and second stimulation apertures in either a random sequence or a predefined sequence.

* * * * *